US005333404A

United States Patent [19]

Lingyak

[11] Patent Number: 5,333,404

[45] Date of Patent: Aug. 2, 1994

[54] LONG GUN STABILIZER

[76] Inventor: Linda S. Lingyak, 117 Kenilworth Dr., Greenwood, S.C. 29649

[21] Appl. No.: 89,282

[22] Filed: Jul. 12, 1993

[51] Int. Cl.[5] ..... F41C 23/12

[52] U.S. Cl. ..... 42/72; 42/71.01; 42/94; 42/75.01

[58] Field of Search ..... 42/71.01, 72, 94, 71.02, 42/75.01, 74, 104

[56] References Cited

U.S. PATENT DOCUMENTS

| | | | |
|---|---|---|---|
| 792,077 | 6/1905 | Renwick | 42/71.02 |
| 809,080 | 1/1906 | Wight | 42/71.01 |
| 898,178 | 9/1908 | Bourne | 42/71.01 |
| 1,277,002 | 8/1918 | Van Name | 42/71.01 |
| 1,585,249 | 5/1926 | Johns | 42/71.01 |
| 1,962,775 | 6/1934 | Jones | 42/71.02 |
| 2,771,697 | 11/1956 | Reising | 42/71.01 |
| 3,128,571 | 4/1964 | Herrett | 42/71.02 |
| 3,209,481 | 10/1965 | Gilbert | 42/71.01 |

FOREIGN PATENT DOCUMENTS

| | | | |
|---|---|---|---|
| 1182910 | 7/1959 | France | 42/94 |
| 404036 | 5/1943 | Italy | 42/72 |

*Primary Examiner*—Stephen M. Johnson

[57] ABSTRACT

A new and improved long gun stabilizer includes a rigid panel element which is connected to a side of the stock of the gun. The rigid panel element projects outward from the side of the stock and is positioned on the side of the stock such that a hand of a user can be placed under the rigid panel element. The rigid panel element rests on the hand of the user, whereby the gun is stabilized on the hand of the user. The rigid panel element includes a contour that is complementary to a contour of a portion of the hand of the user, such as the top portion of the hand. The respective complementary contours provide a snug fit between the top of the hand and the rigid panel element. A channel in the stock receives an edge portion of the rigid panel element. The gun includes a first sight assembly, and the rigid panel element is placed beneath the first sight assembly on the stock. A locking assembly which includes set screws is located in the stock for selectively either securing the rigid panel element to the stock or permitting the rigid panel element to be removed from the stock. Tab portions of the rigid panel element fit into complementary channels in the stock, and set screws selectively engage and lock the respective tab portions. A resilient assembly may be selectively attachable to and removable from the rigid panel element.

8 Claims, 4 Drawing Sheets

FIG. 7
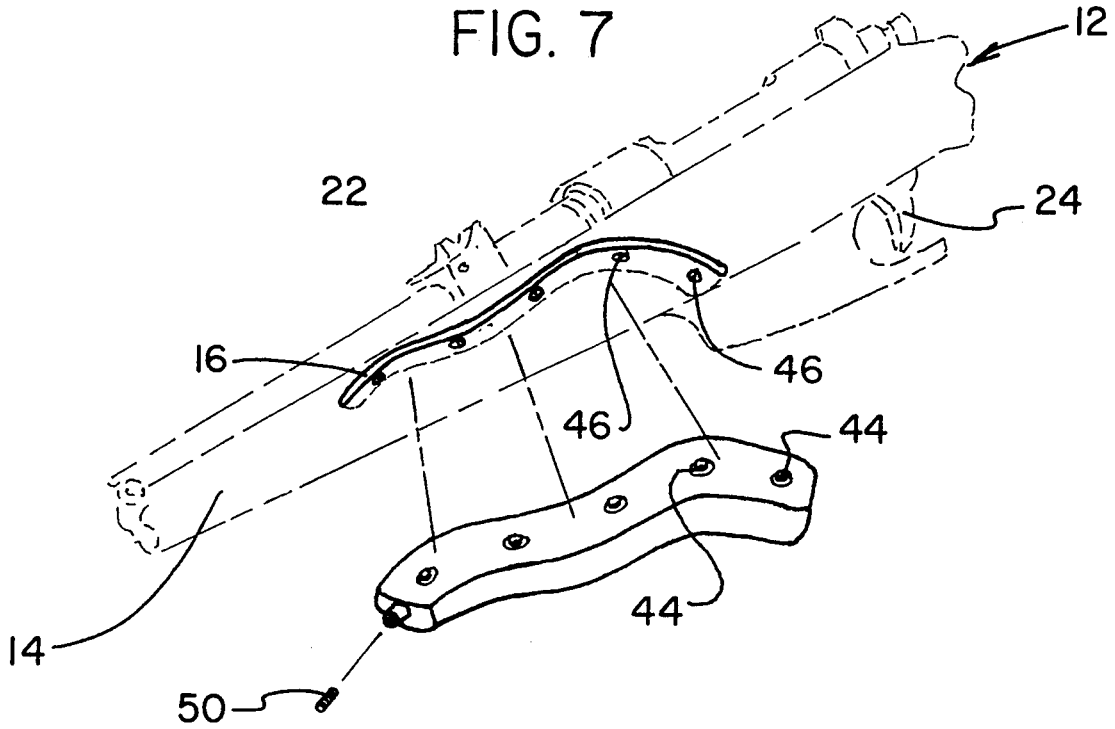
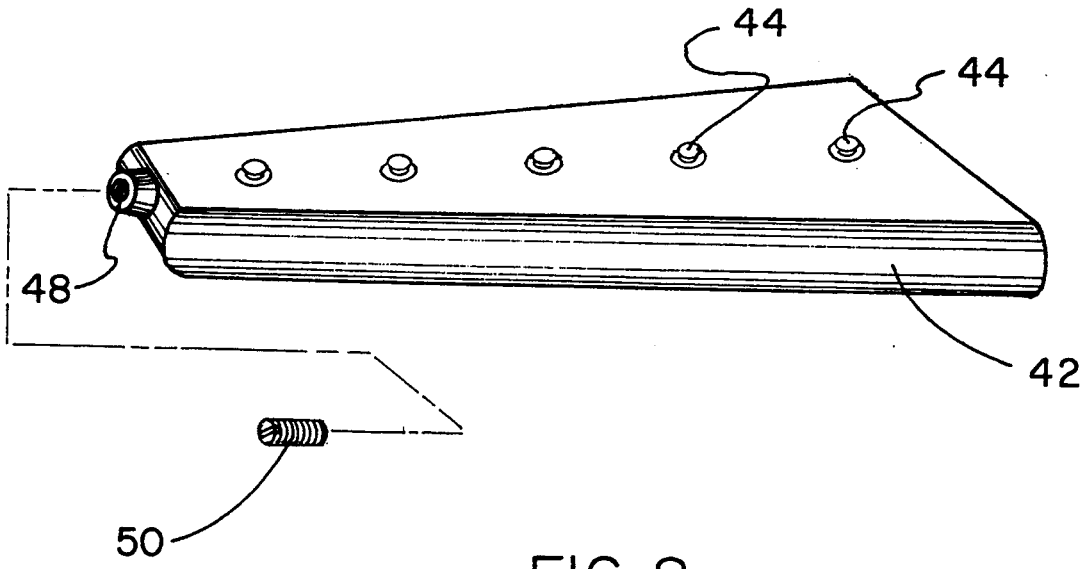
FIG. 8

LONG GUN STABILIZER

BACKGROUND OF THE INVENTION

1. Field of the Invention

The present invention relates generally to firearms, and more particularly, to a stabilizer especially adapted for stabilizing a long gun.

2. Description of the Prior Art

Devices for stabilizing firearms as they are being shot are well known in the art. Throughout the years, a number of innovations have been developed relating to firearm stabilization, and the following U.S. Pat. Nos. are representative of some of those innovations: 4,057,924; 4,162,586; 4,864,761; and 5,048,215.

More specifically, U.S. Pat. No. 4,057,924 discloses a rifle barrel stabilizer that is located between the rifle barrel and the forearm of the stock. A stabilization block is adjusted by an adjustment screw. This device is designed to adjust the force between the rifle barrel and the forearm of the stock.

There is another type of stabilization that is often important in the use of long gun. When a long gun is lifted up and aimed, it is important for accurate shooting that the entire long gun be rendered stable in the hands of the shooter. Only in this way can the shooter maintain a steady aim. The type of stabilization provided by U.S. Pat. No. 4,057,924 will not help the shooter to maintain a steady aim. In this respect, it would be desirable if a long gun stabilizer were provided which enables a shooter to maintain a steady aim.

U.S. Pat. No. 4,162,586 discloses a gun with a cushioned grip safety. This device helps stabilize the hand of the shooter which pulls the trigger of the gun. However, with a long gun, both the hand that pulls the trigger and the hand that holds the stock are important in stabilizing the long gun. This device provides nothing for stabilizing the hand that holds the stock of the long gun. In this respect, it would be desirable if a long gun stabilizer were provided that serves to stabilize the hand of the shooter that holds the stock of the gun.

U.S. Pat. No. 4,864,761 discloses a device designed to dampen vibrations in a rifle after the rifle is shot. The device is secured to the forearm of the rifle with a pressure screw. This device does not appear to be grasped or contacted by the hand of the shooter that holds the stock of the rifle when the rifle is shot. In this respect, this device does not aid in stabilizing the rifle stock when the rifle is aimed.

U.S. Pat. No. 5,048,215 discloses a firearm that includes two handles with two respective hand grips. The first hand grip is grasped by the hand that pulls the trigger. The second hand grip is grasped by the hand which supports the stock of the firearm. The second hand grip can very well be used to stabilize the stock when the firearm is aimed. However, many long guns do not have stocks equipped with hand grips. In fact, many stocks are smooth and straight or slightly curved in contour. In this respect, it would be desirable if a long gun stabilizer were provided that is readily usable with a stock that has a straight or slightly curved contour.

When a shooter raises a long gun for shooting, the weight of the gun is distributed between the shooter's shoulder and the shooter's hand that holds the stock of the gun. When the shooter grasps the stock of the long gun in one hand, it is generally the fingers and the palm of the hand which support a large portion of the weight of the gun. In fact, the palm of the hand supports most of that weight, and the fingers serve to maintain the vertical orientation of the stock. The palm has a relatively small surface area, and supporting the weight on the palm in effect concentrates much of the weight on a relatively small surface area. In this respect, it would be desirable if a long gun stabilizer were provided that employed more surface area than the palm of a hand for stabilizing the stock of the gun.

As mentioned above, the fingers of the hand that holds the stock of the long gun often stabilize the stock from tilting. It would be desirable, however, if more than the fingers could be used to stabilize the stock against tilting.

There are certain additional characteristics that would be desirable in a device for stabilizing a long gun. For example, it would be desirable if the stabilizer were simple in construction and operation. It would also be desirable if a long gun stabilizer improved stability with respect to both the weight distribution and the tilt of the long gun.

Although there are times when a person may desire to use a stabilizer for shooting a long gun, there may be other times that the person may not want to use such a stabilizer. In this respect, it would be desirable if a long gun stabilizer were provided that is easily removable and installable in a stock of a long gun.

The stock of a long gun is generally made of rigid material such as wood. It may be uncomfortable after a while for a person to continuously grasp such a hard stock. In this respect, it would be desirable if a long gun stabilizer were provided that had soft, resilient operating characteristics so as to provide comfort and relief from the rigidity of the hard stock.

There may be times when a shooter would desire options as to whether or not a rigid or resilient long gun stabilizer were desired to be used. In this respect, it would be desirable if a long gun stabilizer were provided that gave a user an option as to whether a relatively rigid or resilient stabilizer were employed.

When an option exists for selecting either a rigid or resilient stabilizer, it would be desirable if exercise of either option could be easily made without a complicated conversion process. In this respect, it would be desirable if a long gun stabilizer were provided that permitted simple conversion from one selected option to another.

Thus, while the foregoing body of prior art indicates it to be well known to use stabilizers for long guns, the prior art described above does not teach or suggest a long gun stabilizer which has the following combination of desirable features: (1) enables a shooter to maintain a steady aim; (2) serves to stabilize the hand of the shooter that holds the stock of the gun; (3) is readily usable with a stock that has a straight or slightly curved contour; (4) employs more surface area than the palm of a hand for stabilizing the stock of the gun; (5) uses more than the fingers to stabilize the stock against tilting; (6) provides a stabilizer that is simple in construction and operation; (7) improves stability with respect to both the weight distribution and the tilt of the long gun; (8) is easily removable and installable in a stock of a long gun; (9) has soft, resilient operating characteristics so as to provide comfort and relief from the rigidity of the hard stock; (10) gives a user an option as to whether a relatively rigid or resilient stabilizer is employed; and (11) permits simple conversion from one selected option to another. The foregoing desired characteristics are provides by the unique long gun stabilizer of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved stabilizer for a gun that has a stock. The apparatus includes a rigid panel element which is connected to a side of the stock. The rigid panel element projects outward from the side of the stock and is positioned on the side of the stock such that a hand of a user can be placed under the rigid panel element, and such that the rigid panel element can rest on the hand of the user, whereby the gun is stabilized on the hand of the user. Means are provided for connecting the rigid panel element to the stock. The rigid panel element includes a contour that is complementary to a contour of a portion of the hand of the user, such as the top portion of the hand. The means for connecting the rigid panel element to the stock include a channel in the stock which receives an edge portion of the rigid panel element. The gun includes a first sight assembly, and the rigid panel element is placed beneath the first sight assembly on the stock.

A locking assembly may be located in the stock for selectively either securing the rigid panel element to the stock or permitting the rigid panel element to be removed from the stock. The locking assembly engages respective tab portions on the rigid panel element for securing the rigid panel element to the stock. The tab portions fit into complementary channels in the stock, and the set screws lock against the tab portions.

More specifically, the locking assembly includes a plurality of set screws capable of being adjusted to engage rigid panel element. A plurality of complementary threaded apertures are in the stock for receiving the set screws A resilient assembly may be selectively attachable to and removable from the rigid panel element. The resilient assembly includes a fluid-containing bladder. A plurality of first connectors are attached to the fluid-containing bladder. The first connectors are capable of connecting with a complementary second connectors on the rigid panel element, whereby the fluid-containing bladder is fixed to the rigid panel element. The fluid-containing bladder may contain a gas such as air or a liquid such as water. The fluid-containing bladder includes a filler aperture and a plug for sealing the filler aperture.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employs herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved long gun stabilizer which has all of the advantages of the prior art and none of the disadvantages.

It is another object of the present invention to provide a new and improved long gun stabilizer which may be easily and efficiently manufactured and marketed.

It is a further object of the present invention to provide a new and improved long gun stabilizer which is of durable and reliable construction.

An even further object of the present invention is to provide a new and improved long gun stabilizer which is susceptible of a low cost of manufacture with regard to both materials and labor, and which accordingly is then susceptible of low prices of sale to the consuming public, thereby making such long gun stabilizer available to the buying public.

Still a further object of the present invention is to provide a new and improved long gun stabilizer which enables a shooter to maintain a steady aim.

Still another object of the present invention is to provide a new and improved long gun stabilizer that serves to stabilize the hand of the shooter that holds the stock of the gun.

Yet another object of the present invention is to provide a new and improved long gun stabilizer which is readily usable with a stock that has a straight or slightly curved contour.

Even another object of the present invention is to provide a new and improved long gun stabilizer that employs more surface area than the palm of a hand for stabilizing the stock of the gun.

Still a further object of the present invention is to provide a new and improved long gun stabilizer which uses more than the fingers to stabilize the stock against tilting.

Yet another object of the present invention is to provide a new and improved long gun stabilizer that provides a stabilizer that is simple in construction and operation.

Another object of the present invention is to provide a new and improved long gun stabilizer which improves stability with respect to both the weight distribution and the tilt of the long gun.

Yet another object of the present invention is to provide a new and improved long gun stabilizer that is easily removable and installable in a stock of a long gun.

Still a further object of the present invention is to provide a new and improved long gun stabilizer that has soft, resilient operating characteristics so as to provide comfort and relief from the rigidity of the hard stock.

An even further object of the present invention is to provide a new and improved long gun stabilizer which gives a user an option as to whether a relatively rigid or resilient stabilizer is employed.

Still a further object of the present invention is to provide a new and improved long gun stabilizer that permits simple conversion from one selected option to another.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

FIG. 7 is a side, partially exploded, perspective view of a third embodiment of the long gun stabilizer of the invention which optionally includes a resilient cushion member.

FIG. 8 is an enlarge perspective view of the resilient cushion member shown in FIG. 7.

DESCRIPTION OF THE PREFERRED EMBODIMENT

Figure 1:
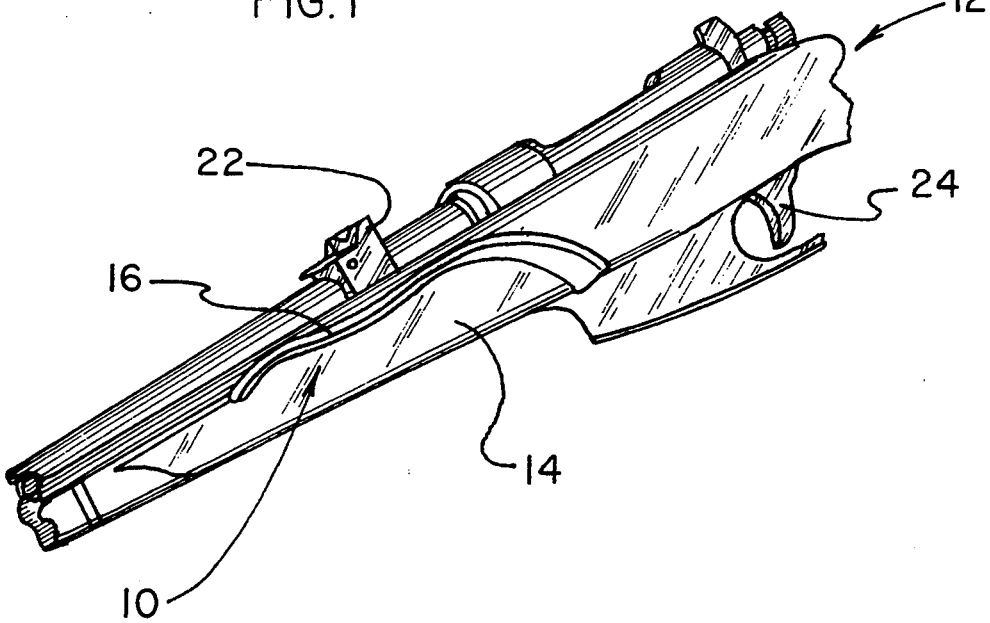
FIG. 1 is a side view showing a first preferred embodiment of the long gun stabilizer of the invention installed on a long gun.
Figure 2:
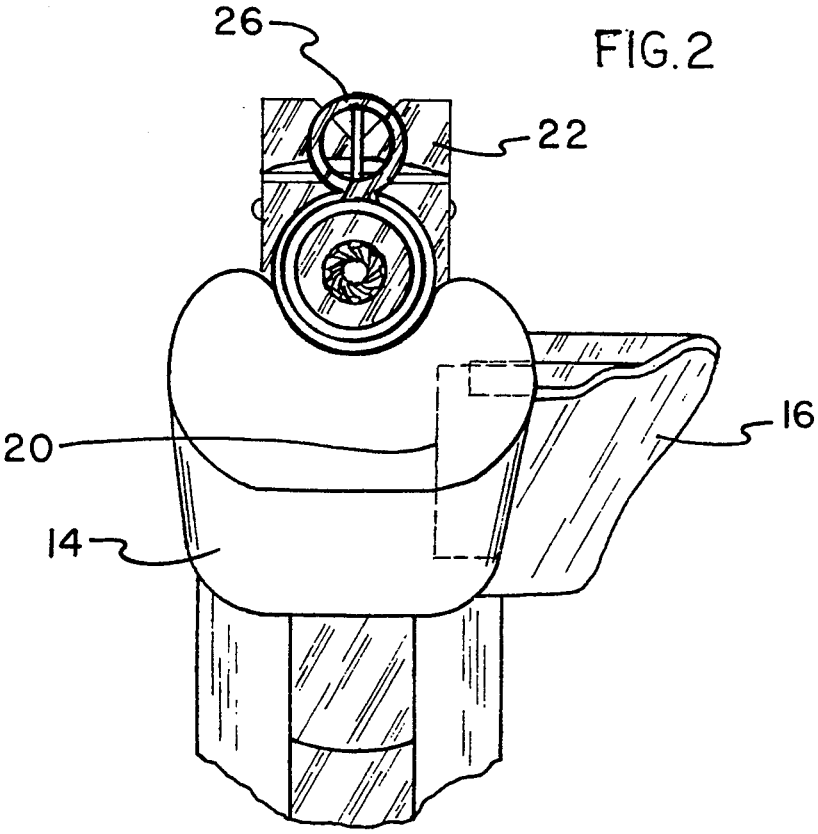
FIG. 2 is an enlarged front view of the long gun stabilizer of the invention installed on the long gun in FIG. 1.
Figure 3:
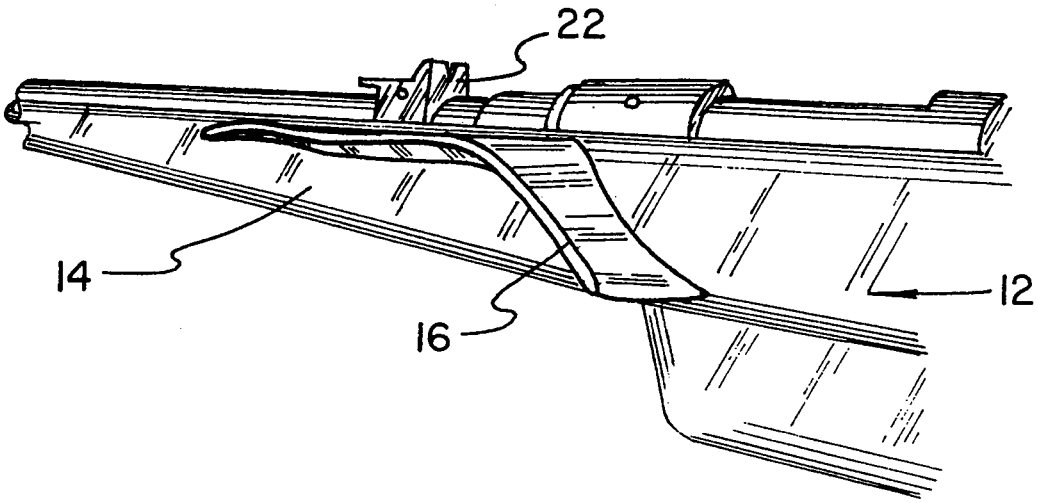
FIG. 3 is a rear perspective view of the long gun stabilizer of FIG. 1.
Figure 4:
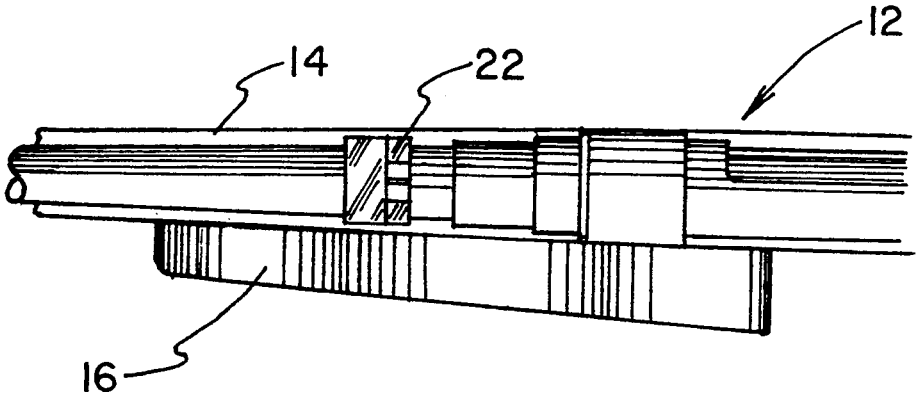
FIG. 4 is a top view of the long gun stabilizer of FIG. 1.

With reference to the drawings, a new and improved long gun stabilizer embodying the principles and concepts of the present invention will be described.

Turning initially to FIGS. 1–4, there is shown a first exemplary embodiment of the long gun stabilizer of the invention generally designated by reference numeral 10. In its preferred form, long gun stabilizer 10 is for a gun 12 that has a stock 14 and includes a rigid panel element 16 which is connected to a side of the stock 14. The rigid panel element 16 projects outward from the side of the stock 14. The rigid panel element 16 positioned on the side of the stock 14 such that a hand of a user (not shown) can be placed under the rigid panel element 16, and such that the rigid panel element 16 can rest on the hand of the user, whereby the gun 12 is stabilized on the hand of the user, and for connecting the rigid panel element 16 to the stock 14. The rigid panel element 16 includes a contour that is complementary to a contour of a portion of the hand of the user. More specifically, the rigid panel element 16 includes a contour that is complementary to a contour of a top portion of the hand of the user. In this respect, the rigid panel element 16 is ergonomically shaped.

The rigid panel element 16 supports some of the weight of the gun 12, and the hand of the user supports the rigid panel element 16. In this way, the weight of the gun 12 is supported by both the palm of the shooter's hand and the top portion of the hand. This combination of support for the weight of the gun serves to stabilize the gun.

The rigid panel element 16 also serves to provide additional stability with respect to tilting of the gun 12. In this way, both the rigid panel element 16 and the shooter's fingers serve to stabilize the gun 12 against tilting. The means for connecting the rigid panel element 16 to the stock 14 include a channel 20 in the stock 14 which receives an edge portion of the rigid panel element 16. The channel 20 in the stock 14 can have a contour which is complementary to the contour of the rigid panel element 16. If desired, the rigid panel element 16 can be permanently fixed in the channel 20 using an adhesive. Otherwise, the rigid panel element 16 can be shoved into the channel 20 and retained by a friction fit. 10 The gun 12 includes a first sight assembly 22, and the rigid panel element 16 is placed beneath the first sight assembly 22 on the stock 14. The first sight assembly 22 is located proximal to the trigger 24. A second sight assembly 26, which is used in conjunction with the first sight assembly 22, is located distal to the trigger 24.

Figure 5:
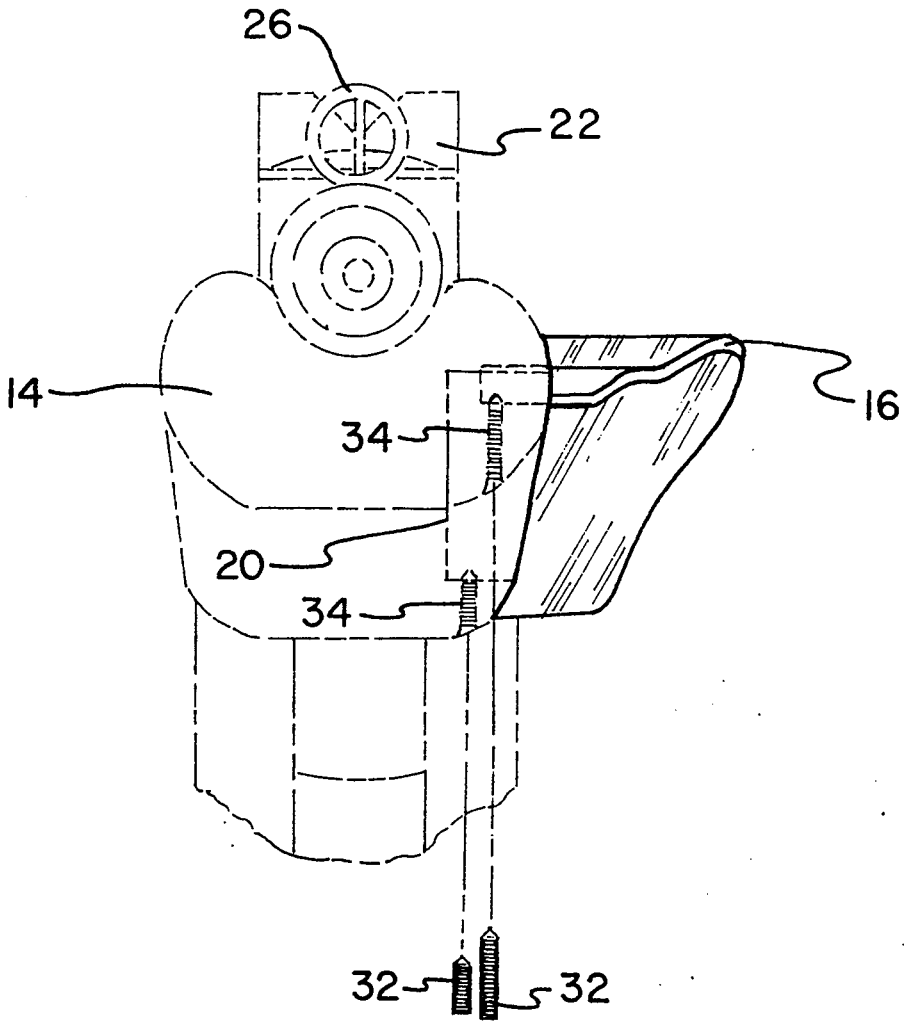
FIG. 5 is a front view of a second embodiment of the long gun stabilizer of the invention, wherein the embodiment can readily be removed from or added to the long gun.
Figure 6:
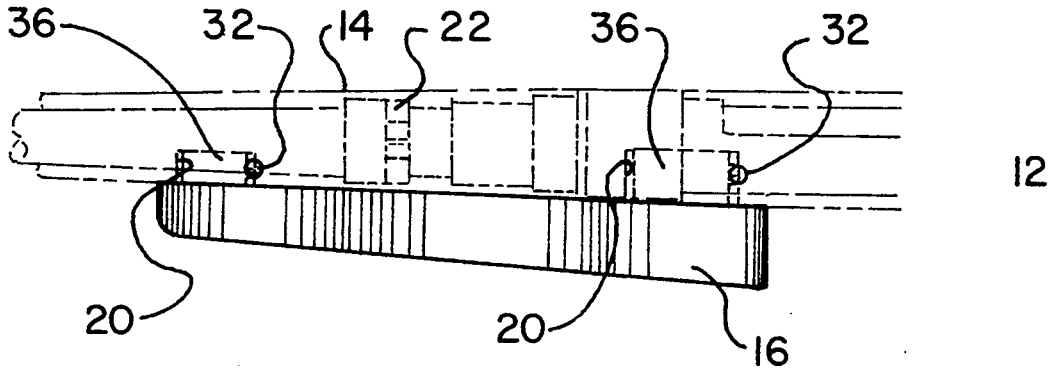
FIG. 6 is a top view of the embodiment of the invention shown in FIG. 5.

Turning to FIGS. 5–6, a second embodiment of the invention is shown. Reference numerals are shown that correspond to like reference numerals that designate like elements shown in the other figures. In addition, a locking assembly 30 is located in the stock 14 for selectively either securing the rigid panel clement 16 to the stock 14 or permitting the rigid panel element 16 to be removed from the stock 14. The locking assembly 30 engages respective tab portions 36 on the rigid panel element 16 for securing the rigid panel element 16 to the stock 14. The tab portions 36 fit into complementary channels 20 in the stock 14, and the set screws 32 lock against the tab portions 36.

In operation, when the set screws 32 are loosened, the rigid panel element 16 can be installed on the stock 14 by inserting the tab portions 36 into the complementary channels 20 in the stock 14. Then the set screws 32 are tightened to lock up against the tab portions 36. In this way, the rigid panel element 16 is secured to the stock 14.

Conversely, when the rigid panel element 16 is to be removed from the stock 14, the set screws 32 are loosened such that they no longer engage the tab portions 36. Then the rigid panel element 16 can be grasped and pulled away from the stock 14, such that the tab portions 36 are pulled out from the channels 20 in the stock 14, whereby the rigid panel element 16 is separated from the stock 14. More specifically, the locking assembly 30 includes a plurality of set screws 32 capable of being adjusted to engage rigid panel element 16. A plurality complementary threaded apertures 34 are in the stock 14 for receiving the set screws 32.

Turning to FIGS. 7–8, a third embodiment of the invention is shown. Reference numerals are shown that correspond to like reference numerals that designate like elements shown in the other figures. In addition, a resilient assembly 40 is selectively attachable to and removable from the rigid panel element 16. The resilient assembly 40 includes a fluid-containing bladder 42. A plurality of first connectors 44 are attached to the fluid-containing bladder 42. The first connectors 44 are capable of connecting with a complementary second connectors 46 on the rigid panel element 16, whereby the fluid-containing bladder 42 is fixed to the rigid panel clement 16. The complementary first connectors 44 and the second connectors 46 are shown to be male snap members and complementary female snap members, respectively. The fluid-containing bladder 42 may contain a gas such as air or a liquid such as water. The fluid-containing bladder 42 includes a filler aperture 48 and a plug 50 for sealing the filler aperture 48.

The components of the long gun stabilizer of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved long gun stabilizer that is low in cost, relatively simple in design and operation, and which may advantageously be used to enable a shooter to maintain a steady aim. With the invention, a long gun stabilizer is provided which serves to stabilize the hand of the shooter that holds the stock of the gun. With the invention, a long gun stabilizer is provided which is readily usable with a stock that has a straight or slightly curved contour. With the invention, a long gun stabilizer is provided which employs more surface area than the palm of a hand for stabilizing the stock of the gun. With the invention, a long gun stabilizer is provided which uses more than the fingers to stabilize the stock against tilting. With the invention, a long gun stabilizer is provided which provides a stabilizer that is simple in construction and operation. With the invention, a long gun stabilizer is provided which improves stability with respect to both the weight distribution and the tilt of the long gun. With the invention, a long gun stabilizer is provided which is easily removable and installable in a stock of a long gun. With the invention, a long gun stabilizer is provided which has soft, resilient operating characteristics so as to provide comfort and relief from the rigidity of the hard stock. With the invention, a long gun stabilizer is provided which gives a user an option as to whether a relatively rigid or resilient stabilizer is employed. With the invention, a long gun stabilizer is provided which permits simple conversion from one selected option to another.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved stabilizer for a gun that has a stock, said apparatus comprising:

a rigid panel element connected to a side of the stock, said rigid panel element projecting outward from the side of the stock, said rigid panel element positioned on the side of the stock such that a hand of a user can be placed under said rigid panel element, and such that said rigid panel element can rest on the hand of the user, whereby the gun is stabilized on the hand of the user, and means for connecting said rigid panel element to the stock, wherein said means for connecting said rigid panel element to the stock include a channel in the stock which receives an edge portion of said rigid panel element, said channel having a contour complimentary to the contour of said rigid panel element, said contour of said rigid panel element and said channel being irregular ergonomically conform to the curvature of a portion of the human hand.

2. The apparatus described in claim 1 wherein:

the gun includes a first sight assembly, and said rigid panel clement is placed beneath the first sight assembly on the stock.

3.The apparatus described in claim 1, further including:

a resilient assembly attachable to said rigid panel element.

4. A new and improved stabilizer for a gun that has a stock, said apparatus comprising:

a rigid panel element connected to a side of the stock, said rigid panel element projecting outward from the side of the stock, said rigid panel element positioned on the side of the stock such that a hand of a user can be placed under said rigid panel element, and such that said rigid panel element can rest on the hand of the user, whereby the gun is stabilized on the hand of the user, and means for connecting said rigid panel element to the stock, further including:

locking assembly means, located in the stock, for selectively either securing said rigid panel element to the stock or permitting said rigid panel element to be removed from the stock, said locking assembly means engaging respective tab portions on said rigid panel element for securing said rigid panel element to the stock, said tab portions fitting into complementary channels in the stock, and said locking assembly means locking against said tab portions.

5. The apparatus described in claim 4 wherein said rigid panel element includes a contour that is complementary to a contour of a portion of the hand of the user.

6. The apparatus described in claim 4 wherein said rigid panel element includes a contour that is complementary to a contour of a top portion of the hand of the user.

7. The apparatus described in claim 4 wherein said means for connecting said rigid panel element to the stock include a channel in the stock which receives an edge portion of said rigid panel element.

8. The apparatus described in claim 4 wherein said locking assembly means include:

a plurality of set screws capable of being adjusted to engage said rigid panel element, and a plurality complementary threaded apertures in the stock for receiving said set screws.

* * * * *